US007665829B2

(12) United States Patent
Ueno et al.

(10) Patent No.: US 7,665,829 B2
(45) Date of Patent: Feb. 23, 2010

(54) LIQUID SOLUTION EJECTING APPARATUS

(75) Inventors: Nobuhiro Ueno, Takatsuki (JP); Isao Doi, Toyonaka (JP); Yasuo Nishi, Hachioji (JP); Nobuhisa Ishida, Kyoto (JP)

(73) Assignee: Konica Minolta Holdings, Inc., Tokyo (JP)

( * ) Notice: Subject to any disclaimer, the term of this patent is extended or adjusted under 35 U.S.C. 154(b) by 427 days.

(21) Appl. No.: 11/632,408

(22) PCT Filed: Jul. 20, 2005

(86) PCT No.: PCT/JP2005/013306

§ 371 (c)(1),
(2), (4) Date: Jan. 12, 2007

(87) PCT Pub. No.: WO2006/011403

PCT Pub. Date: Feb. 2, 2006

(65) Prior Publication Data

US 2007/0200898 A1 Aug. 30, 2007

(30) Foreign Application Priority Data

Jul. 26, 2004 (JP) ..... 2004-217500

(51) Int. Cl.
*B41J 2/045* (2006.01)

(52) U.S. Cl. ..... 347/68

(58) Field of Classification Search ..... 374/54, 374/55–57, 61, 63, 40–42, 44, 47, 49, 68
See application file for complete search history.

(56) References Cited

U.S. PATENT DOCUMENTS

| | | | |
|---|---|---|---|
| 5,278,583 | A | 1/1994 | Oda et al. |
| 2006/0017782 | A1 | 1/2006 | Nishi et al. |
| 2006/0043212 | A1 | 3/2006 | Nishi et al. |
| 2006/0049272 | A1 | 3/2006 | Nishi et al. |

FOREIGN PATENT DOCUMENTS

| | | | |
|---|---|---|---|
| JP | 05-000509 | A | 1/1993 |
| JP | 11-020169 | A | 1/1999 |
| JP | 2003-039682 | A | 2/2003 |
| JP | 2003-311944 | A | 11/2003 |
| JP | 2004-136653 | A | 5/2004 |
| JP | 2004-136655 | A | 5/2004 |
| JP | 2004136651 | | 5/2004 |
| JP | 2004136652 | | 5/2004 |
| WO | WO 2004/028815 | A1 | 4/2004 |

*Primary Examiner*—K. Feggins
(74) *Attorney, Agent, or Firm*—Frishauf, Holtz, Goodman & Chick, P.C.

(57) ABSTRACT

Liquid ejecting apparatus 20 for ejecting electrically charged droplets of the liquid solution onto base member K, which includes liquid ejecting head 26 to eject the droplets from top end 21*a* of nozzle 21, with the inner diameter equal to or less than 100 μm, liquid solution supplying section 29 to supply the liquid solution into nozzle 21, and ejection voltage applying section 25 to apply the ejection voltage onto the liquid solution in nozzle 21. In liquid ejecting apparatus 20, nozzle 21 projects toward the droplet ejecting direction from nozzle plane 26*e* on nozzle plate 26*c* facing base member K, whereby the projecting length of nozzle 21 is equal to or less than 30 μm.

11 Claims, 11 Drawing Sheets

LIQUID SOLUTION EJECTING APPARATUS

This application is the U.S. national phase application of International application PCT/JP2005/013306 filed Jul. 20, 2005.

TECHNICAL FIELD

The present invention relates to an electrostatic type liquid ejecting apparatus to eject droplets of electrically-charged liquid solution onto a base member.

BACKGROUND TECHNOLOGY

In recent years, well known as a technology to eject the droplets of the liquid solution onto an object material, is a so-called electrostatic liquid solution ejecting technology which electrically charges the liquid solution in a nozzle, and generates an electrical field between the object material and the nozzle, after which the droplets of the charged liquid solution are ejected from the top end of the nozzle onto the object material. The electrostatic liquid solution ejecting technology of interest applies ink or electrically conductive paste as the liquid solution to be ejected, and which is preferably used for placing minute dots to form high quality images on a recording medium, or which is preferably used for forming an ultra-fine wiring pattern on a circuit plate.

Typically, a regular liquid ejecting apparatus (a head to eject the liquid) to eject the electrically conductive liquid solution allows the nozzle to project slightly from a supporting member (such as a nozzle plate), and uses an electrical field concentrating function at the top of the protruded nozzle. Accordingly, the nozzle is a very important section for the liquid solution ejecting performance. As an example of this nozzle, Patent Document 1 discloses nozzle 15 which is formed of silicon oxide, and projects about 10-400 μm, while Patent Document 2 discloses an isosceles triangle shaped nozzle (which is ink ejecting section 16), formed by a cutting operation.

[Patent Document 1] Unexamined Japanese Patent Application Publication No. 2003-311,944 (see paragraph 0035, and FIG. 3)

[Patent Document 2] Unexamined Japanese Patent Application Publication No. 2003-39,682 (see paragraph 0014, and FIG. 1)

However, in the above-described liquid ejecting apparatus using a method in which the electrical field is concentrated to the top of the nozzle, due to the nozzle protruded from the supporting member of the nozzle, it is very difficult for a wiping operation (which means to wipe the surface of the nozzles by a rubber blade and the like) for the cleaning, which is an important factor for stable ejecting action of the liquid solution, and thereby a major maintenance problem results, in addition, the ejecting performance may be reduced.

DISCLOSURE OF THE INVENTION

An object of the present invention is to provide a liquid ejecting apparatus featuring excellent ejecting performance, in which wiping for the cleaning operation is conducted with ease.

An embodiment of the present invention to solve the above-described problem is a liquid ejecting apparatus which ejects droplets of electrically charged liquid solution onto a base member is characterized in that:

a liquid ejecting head having a nozzle whose inside diameter is equal to or less than 100 μm to eject the droplets from a top of the nozzle;

a liquid solution supplying section to supply the liquid solution to the nozzle; and an ejection voltage applying section to apply an ejection voltage to the liquid solution in the nozzle; wherein the nozzle is protruded from a nozzle plane in an ejecting direction of the droplets, and a height of the nozzle is equal to or less than 30 μm.

BRIEF DESCRIPTION OF THE DRAWINGS

FIG. 4 explains the relationship between an ejecting condition of the liquid solution and the voltage applied to the liquid solution, wherein FIG. 4(A) shows the relationship in a non-ejecting condition, while FIG. 4(B) shows the relationship in an ejecting condition.

FIG. 6 shows the varied examples which are used instead of the nozzle plate and the nozzle in FIG. 1 and FIG. 2, wherein FIG. 6(A) is a cross sectional view (an upper stage) and a plan view (a lower stage), while FIG. 6(B) is a cross sectional view of example varied from FIG. 6(A).

DESCRIPTION OF THE PREFERRED EMBODIMENTS

Figure 1:
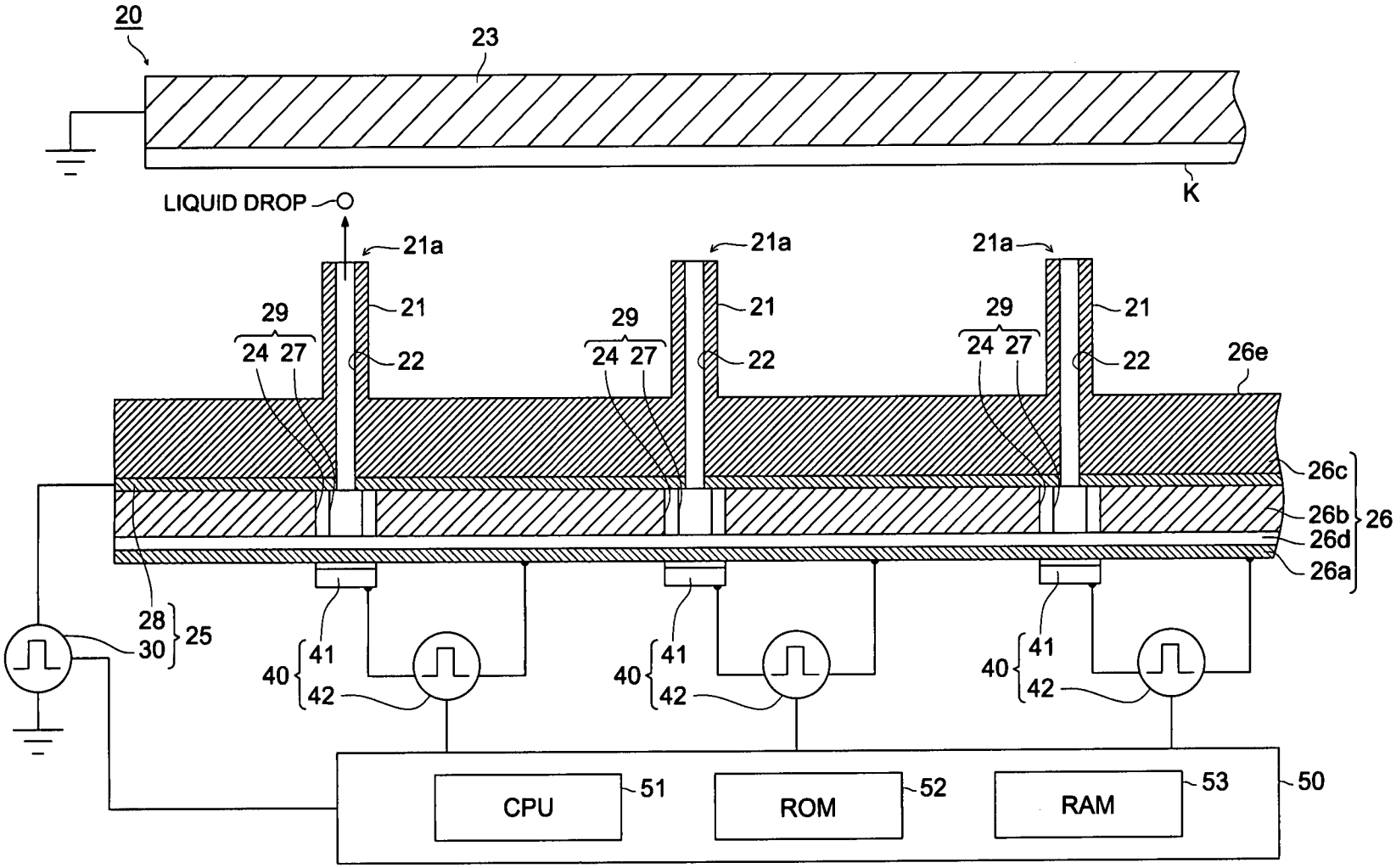
FIG. 1 is a cross sectional view of the liquid ejecting apparatus.

The problem of the present invention will be attained by the structures described below.

Structure (1) A liquid ejecting apparatus which ejects droplets of electrically charged liquid solution onto a base member, including:

a liquid solution ejecting head having a nozzle whose inside diameter is equal to or less than 100 μm to eject the droplets from a top of the nozzle;

a liquid solution supplying section to supply the liquid solution to the nozzle; and an ejection voltage applying section to apply an ejection voltage to the liquid solution in the nozzle; wherein the nozzle is protruded from a nozzle plane in an ejecting direction of the droplets, and the height of the nozzle is equal to or less than 30 μm.

Structure (2) The liquid ejecting apparatus described in Structure (1), wherein the height of the nozzle. is equal to or higher than 3 μm but less than 10 μm.

Structure (3) A liquid ejecting apparatus which ejects droplets of the electrically charged liquid solution onto a base member, including:

a liquid ejecting head having a nozzle whose inside diameter is equal to or less than 100 μm to eject the droplets from a top of the nozzle;

a liquid solution supplying section to supply the liquid solution to the nozzle; and an ejection voltage applying section to apply an ejection voltage to the liquid solution in the nozzle; wherein a groove is formed around the nozzle.

Structure (4) The liquid ejecting apparatus described in Structure (3), wherein the width of the groove is 3-1,000 μm.

Structure (5) The liquid ejecting apparatus described in Structure (3), wherein the width of the groove is 10-100 μm.

Structure (6) The liquid ejecting apparatus described in any one of Structures (3)-(5), wherein the depth of the groove is 1-30 μm.

Structure (7) The liquid ejecting apparatus described in any one of Structures (3)-(6), wherein the depth of the groove is equal to the height of the nozzle.

Structure (8) The liquid ejecting apparatus described in any one of Structures (3)-(6), wherein the depth of the groove is greater than the height of the nozzle.

Structure (9) The liquid ejecting apparatus described in Structure (8), wherein the depth of the groove is 1-20 μm greater than the height of the nozzle.

Structure (10) The liquid ejecting apparatus described in any one of Structures (1)-(9), wherein the length of a flow channel formed in the nozzle is equal to or greater than 75 μm, and the electric conductivity of a material to structure the nozzle is equal to or less than $10^{-13}$ S/m.

Structure (11) The liquid ejecting apparatus described in any one of Structures (1)-(10), wherein the length of the flow channel formed in the nozzle is equal to or greater than 100 μm.

Structure (12) The liquid ejecting apparatus described in any one of Structures (1)-(11), wherein the electric conductivity of a material to structure the nozzle is equal to or less than $10^{-14}$ S/m.

Structure (13) The liquid ejecting apparatus described in any one of Structures (1)-(12), wherein a water repellent finish is conducted on a surface of the nozzle.

Structure (14) The liquid ejecting apparatus described in any one of Structures (1)-(13), wherein the water repellent finish is conducted on an inner surface of the flow channel formed in the nozzle.

Structure (15) The liquid ejecting apparatus described in any one of Structures (1)-(14), wherein an opposed electrode is provided to face the nozzle through the base member, and the opposed electrode is a plate or a drum shaped.

Structure (16) The liquid ejecting apparatus described in any one of Structures (1)-(15), wherein the inner diameter of the nozzle is equal to or less than 30 μm.

Structure (17) The liquid ejecting apparatus described in any one of Structures (1)-(16), wherein the inner diameter of the nozzle is equal to or less than 10 μm.

Structure (18) The liquid ejecting apparatus described in any one of Structures (1)-(17), wherein the inner diameter of the nozzle is equal to or less than 4 μm.

Structure (19) The liquid ejecting apparatus described in any one of Structures (1)-(18), wherein the inner diameter of the nozzle is equal to or greater than 0.1 μm, but less than 1 μm.

In the structures described in Structures (1), (2), and (10)-(19), since the height of the nozzle is determined to be equal to or less than 30 μm, a wiping member hardly ever hooks onto the nozzles while cleaning them. Therefore, wiping can be conducted with ease for cleaning, and it is possible to prevent damage to the nozzles caused by hooking of the wiping blade, or to prevent a part of the wiping member as a fragment from attaching to the nozzle, which can properly retain the ejecting performance of the nozzle.

In the structures described in Structures (3)-(9), and (10)-(19), since the groove is formed around the nozzle, a part of a pressing force of the wiping member works on the inner surface of the groove while cleaning, the pressing force of the wiping member to the nozzle is reduced, and the wiping member hardly ever hooks onto the nozzles. Therefore, effective wiping can be conducted with ease for cleaning, and it is possible to prevent damage of the nozzle caused by being hooked, or to prevent a part of the wiping member as a fragment from attaching to the nozzle, which helps to assure proper ejecting performance of the nozzle.

The best mode to carry out the present invention will now be detailed while referring to the drawings. The scope of the invention is not limited to the illustrated examples.

(Whole Structure of the Liquid Ejecting Apparatus)

FIG. 1 is a cross sectional view of liquid ejecting apparatus 20 relating to the present invention.

Liquid ejecting apparatus 20 includes:

liquid ejecting head 26 having nozzle 21 whose diameter is ultra-fine to eject the droplets of the electrically chargeable liquid solution from its top end 21*a;* opposed electrode 23 to face top end 21*a* of nozzle 21 and supports base member K whose surface, facing top end 21*a*, receives the ejected droplets;

liquid solution supplying section 29 to supply the liquid solution into flow channel 22 in nozzle 21;

ejection voltage applying section 25 to apply the ejection voltage onto the liquid solution in nozzle 21;

convex meniscus forming section 40 to allow the liquid solution in nozzle 21 to rise from top end 21*a* of nozzle 21; and operation control section 50 to control the application of the drive voltage of convex meniscus forming section 40 and the application of the ejection voltage generated from ejection voltage applying section 25.

Plural nozzles 21 are provided on liquid ejecting head 26, and each nozzle 21 is arranged in a single plane, facing in the same direction. Therefore, liquid solution supplying section 29 is formed in liquid ejecting head 26 for each nozzle 21, and convex meniscus forming section 40 is also provided in liquid ejecting head 26 for each nozzle 21. On the other hand, single ejection voltage applying section 25 as well as single opposed electrode 23 is provided, which are commonly used for all nozzles 21.

In addition, to explain conveniently, top ends 21*a* of nozzle 21 face upward, and opposed electrode 23 is arranged above nozzle 21 in FIG. 1. However, nozzle 21 actually faces the horizontal direction or a slightly lower direction, and more preferably, faces downward vertically. Further, in order to determine the relative moving positions of liquid ejecting head 26 and base member K, liquid ejecting head 26 and base member K are conveyed by a position determining section which is not illustrated. Accordingly the droplets ejected from each nozzle 21 of liquid ejecting head 26 can be landed at the desired position on base member K.

(Nozzle)

Each nozzle 21 is integrally formed of with nozzle plate 26*c* which will be detailed below, and each nozzle 21 projects vertically from a flat surface (being a upper surface of nozzle plate 26*c* in FIG. 1, and hereinafter is referred to as "nozzle plane 26*e*") in an ejecting direction of the droplets. When the droplets are ejected, each nozzle 21 is used while facing vertically a receiving surface (being a surface on which the droplets are deposited) of base member K.

Flow channel 22 is formed in each nozzle 21 to pass through the center of nozzle 21 from top end 21*a*. Flow channel 22 is connected to liquid solution chamber 24 which will be detailed below, and flow channel 22 sends the liquid solution from liquid solution chamber 24 to top end 21*a*. The water repellent finish is applied onto the surface of top end 21*a* of each nozzle 21, and the inner surface of flow channel 22. Therefore, this structure allows the curvature radius of the convex-shaped meniscus formed at top end 21*a* of each nozzle 21 to be close to the inner diameter of nozzle 21.

Nozzles 21 will be further detailed below.

Figure 2:
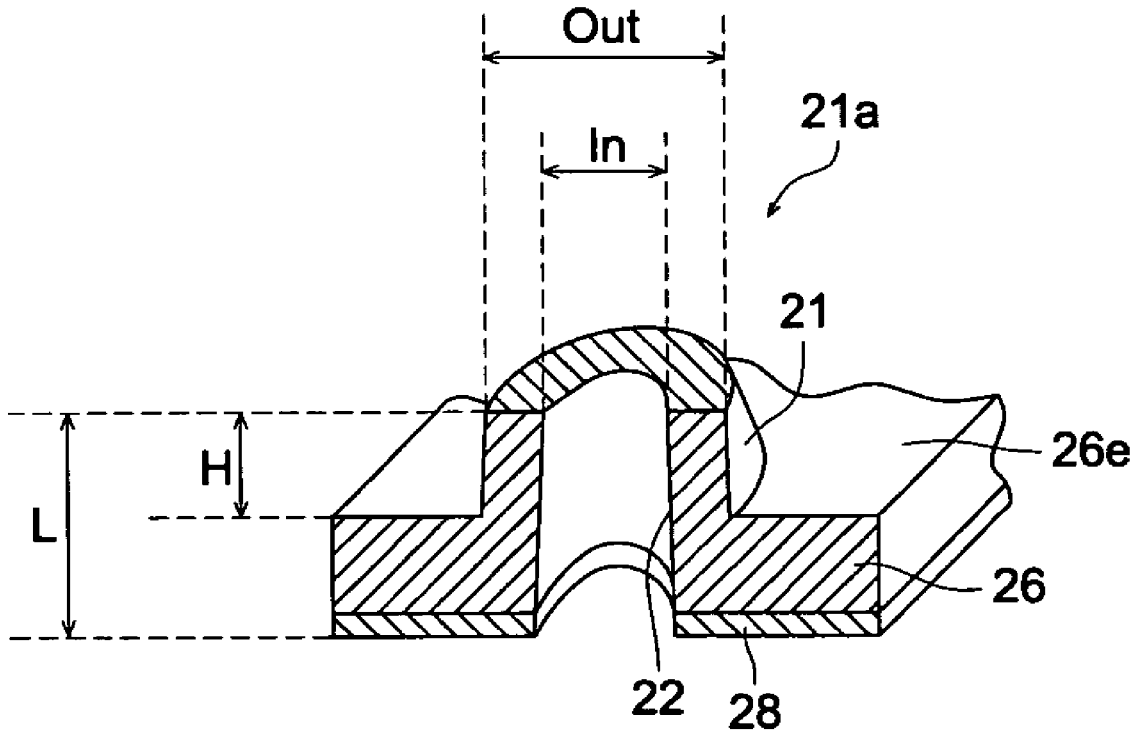
FIG. 2 is a perspective view of a cross sectioned nozzle.

FIG. 2 is a cross sectional perspective view to detail nozzle 21.

In FIG. 2, the inner diameter of nozzle 21 is represented by "In", while the outer diameter of nozzle 21 is represented by "Out". Each nozzle 21 is cylindrical in which "In" and "Out" are constant. The greater the inner diameter, the greater the diameter of the ejected droplet. If the inner diameter is greater than 100 μm, the nozzle can not generate the targeted ultra-fine dots, the image with high quality can not be formed, or the targeted minute wiring pattern can not be formed, which are not suited for the object of the present invention. Accordingly, inner diameter "In" of each nozzle 21 is determined to be equal to or less than 100 μm, but preferably is equal to or less than 30 μm, more preferably is equal to or less than 10 μm, further more preferably is equal to or less than 4 μm, and most preferably is equal to or greater than 0.1 μm, but less than 1 μm.

The height of nozzle 21 is represented by H. Height H of each nozzle 21 is determined to be equal to or less than 30 μm, and more preferably is equal to or greater than 3 μm, but less than 10 μm. In well-known electrostatic type liquid ejecting apparatuses, the electric field is formed between the nozzle and-the opposed electrode, and the liquid solution is electrically charged. Therefore, the force (which generates electro wetting) functions to get wet and spread the liquid solution on the edges of the top end of each nozzle. That is, the leaking phenomenon of the liquid solution is generated, due to which the electrode can not be concentrated at the top end of the nozzle, resulting in undesired ejection. However, in liquid ejecting apparatus 20 relating to the present invention, height H of the nozzle is equal to or less than 30 μm, which means the projecting height is very minute. Accordingly, the leak of the liquid solution is effectively controlled in liquid ejecting apparatus 20. Further, as a feasible height H of nozzle 21, a minimum of 3 μm is necessary.

Figure 8:
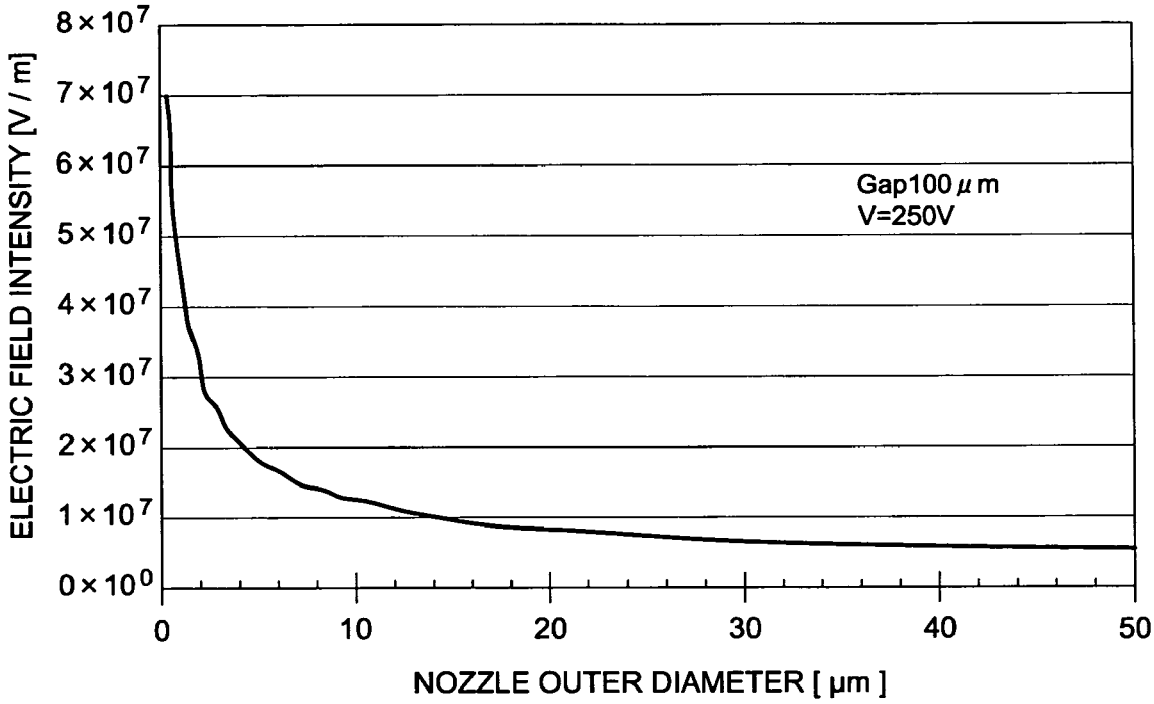
FIG. 8 shows the general relationship between the nozzle outer diameter and an electric field intensity.

Since electric field intensity depends upon the outer diameter of the meniscus formed at the top of the nozzle, in case 1 in which the outer diameter of the meniscus is equal to the inner diameter of the nozzle so that the liquid solution does not leak and spread at the top end of the nozzle, the electric field intensity depends upon the inner diameter of the nozzle. While in case 2 in which the liquid solution leaks and spreads at the top end of the nozzle due to the electro-wetting phenomenon, the meniscus is formed on a base which is the nozzle's outer diameter, and the electric field intensity depends upon the outer diameter of the nozzle. Whether to belong to case 1 or case 2 depends upon the physical properties of the liquid solution to be used. FIG. 8 is a graph showing the relationship between the electric intensity and the outer diameter in case 2 in which the electric field intensity depends upon the outer diameter.

In each nozzle 21, the smaller outer diameter "Out", the greater electric intensity (see FIG. 8), which results in better ejection of the liquid solution, while the smaller inner diameter "In", the greater flow channel resistance (which functions to the liquid solution in flow channel 22), which results in unacceptable ejection of the liquid solution. Accordingly, nozzles 21 having the smaller thickness result in good ejection, and the thickness of the nozzle should be determined within a practical range, by considering the producing practicality. Specifically, average thickness T of each nozzle 21 satisfies following Formula (11), but more preferably Formula (12).

$$T=(Out-In)/2 \leqq 1\ (\mu m) \qquad \text{Formula (11)}$$

$$T=(Out-In)/2 \leqq 0.5\ (\mu m) \qquad \text{Formula (12)}$$

In addition, in each nozzle 21, there is no need to make outer diameter "Out" and inner diameter "In" to be constant values, but either outer diameter "Out" or inner diameter "In" can be tapered toward opposed electrode 23. In this case, outer diameter "Out" of each nozzle 21 corresponds to the outer diameter of the central section of nozzle 21. Average thickness T of each nozzle 21 is calculated by outer diameter "Out" and inner diameter "In" of the central section of nozzle 21, and its condition preferably should satisfy at least formula (11), but more preferably formula (12).

Figure 3:
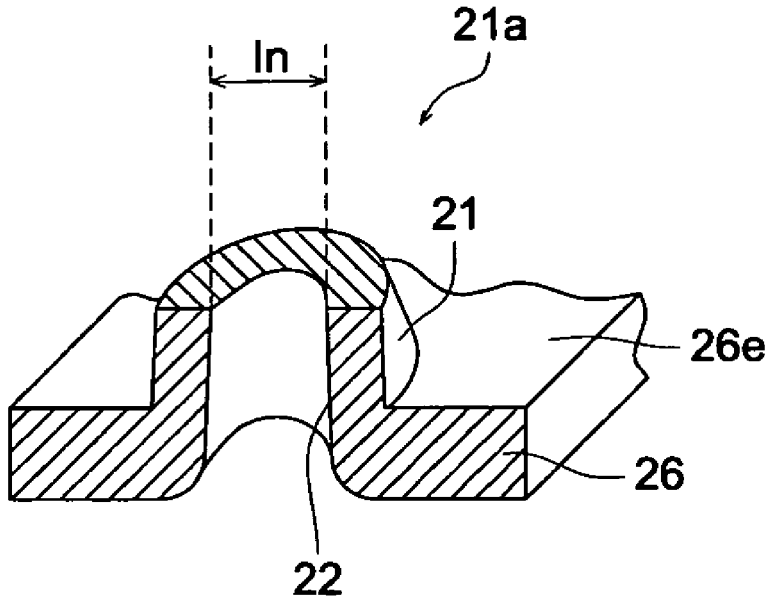
FIG. 3(A) and FIG. 3(B) show the varied examples of flow channels varied from the perspective view of the cross sectioned nozzle of FIG. 2.
Figure 3:
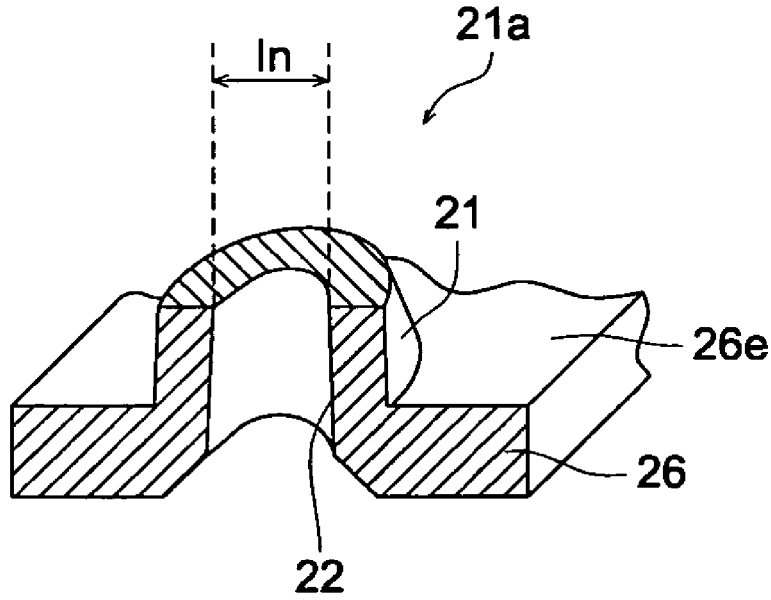

Regarding the end section of flow channel 22, leading to after-mentioned liquid solution chamber 24, the cross sectional shape of the end section shows it to be rounded in FIG. 3(A), or only the end section of liquid solution chamber 24 of flow channel 22 is formed to be a tapered periphery surface, and a section between top end 21*a* and the tapered periphery surface is straightened with constant inner diameter "In" as shown in FIG. 3(B).

(Liquid Solution Supplying Section)

Each liquid solution supplying section 29 includes:

liquid solution chamber 24 which is provided on an end section side of corresponding nozzle 21 in liquid ejecting head 26, and leads to flow channel 22;

supplying channel 27 to send the liquid solution from the outer liquid solution tank, which is not illustrated, to liquid solution chamber 24; and a pump, which is not illustrated, to apply pressure to the liquid solution toward liquid solution chamber 24.

The pump supplies the liquid solution to top ends 21*a* of nozzles 21, and under the condition that ejection voltage applying section 25 as well as convex meniscus forming section 40 are de-activated, the pump supplies the liquid solution using the retained pressure whose scope is controlled not to make the liquid solution project from top end 21*a* of each nozzle 21 (that is, the scope of pressure does not create convex-shaped meniscus).

In addition, the above-described pump includes a case in which differential pressure, generated by the difference of the respective vertical positions of liquid ejecting heads 26 and the liquid solution tank, is used. Accordingly, it is possible to apply the liquid solution while using only the liquid solution flow channels, without using any liquid solution supplying section. The pump system is fundamentally designed in such a way that the pump supplies the liquid solution to liquid ejecting head 26 at the start of printing operations, so that liquid ejecting head 26 ejects the liquid, The new liquid solution is supplied based on the ejected liquid, so as to optimize the change of volume of the liquid solution remaining in liquid ejecting head 26, wherein the change is caused by capillary effect and convex meniscus forming section 40, and which in turn optimizes the pressure of the pump.

(Ejection Voltage Applying Section)

Ejection voltage applying section 25 is provided with ejecting electrode 28 to apply the ejection voltage, which is assembled at a border position between liquid solution chamber 24 and flow channel 22 in liquid ejecting head 26; and pulse voltage power supply 30 to apply sharply-rising electric pulse voltage to ejecting electrode 28.

Though the details will be described later, liquid ejecting head 26 is provided with a layer to form each nozzle 21, and layers to form each liquid solution chamber 24 and supplying channel 27, wherein ejecting electrode 28 is assembled the entire border of these layers. Accordingly, single ejecting electrode 28 comes into contact with the liquid solution in all liquid solution chambers 24, whereby, the ejection voltage is applied to single ejecting electrode 24 so that the liquid solution to be conveyed to all nozzles 21 can be electrically charged.

The range of the ejection voltage generated from pulse voltage power supply 30 is determined so that the ejection can be performed adequately, under the condition that the convex-shaped meniscus of the liquid solution is formed on top end 21*a* of nozzle 21 by convex meniscus forming section 40. The ejection voltage which is to be applied by pulse voltage power source 30 can be theoretically obtained by following Formula (1).

$$h\sqrt{\frac{\gamma\pi}{\varepsilon_0 d}} > V > \sqrt{\frac{\gamma k d}{2\varepsilon_0}} \qquad \text{Formula (1)}$$

In Formula (1),

γ: surface tension of the liquid solution (N/m)

$\epsilon_0$: dielectric constant in vacuum (F/m)

d: nozzle diameter (m)

h: distance between a nozzle and a base member (m)

k: proportionality constant depending upon the nozzle shape ($1.5<k<8.5$)

In addition, the condition shown in formula (1) is theoretical, in practice adequate voltage can be obtained by the experimentation so that the appropriate convex-shaped meniscus is formed, or not formed. In the present embodiment, the ejection voltage is 400 V, as an example.

(Liquid Ejecting Head)

Liquid ejecting head 26, positioned as the lowest position in FIG. 1, includes:

flexible base layer 26*a* formed of a flexible material (such as metal, silicon, or resin); insulating layer 26*d* formed of an insulating material over the entire surface of flexible base layer 26*a;* flow channel layer 26*b* to form the supply channel of the liquid solution on insulating layer 26*d*; and nozzle plate 26*c* formed further on flow channel layer 26*b*. Ejecting electrode 28 described above is sandwiched between flow channel layer 26*b* and nozzle plate 26*c*.

If flexible base layer 26*a* is a flexible material, for example, a thin metallic plate can be used. Because piezo element 41 of convex meniscus forming section 40, which will be detailed later, is assembled on a position corresponding to liquid solution chamber 24 on the outer surface of flexible base layer 26*a*, so that flexible base layer 26*a* becomes flexible. That is, when a predetermined voltage is applied to piezo element 41, flexible base layer 26*a* is curved both inward and outward at the above-described position, then the inner volume of liquid solution chamber 24 is decreased and increased. The change of inner pressure generates the convex-shaped meniscus of the liquid solution at top end 21*a* of nozzle 21, or makes the liquid surface to pull in.

On flexible base layer 26*a*, insulating layer 26*d*, which is a coat of high insulating resin, is formed. Insulating layer 26*d* is formed thin enough to flex easily, not to prevent flexible base member 26*a* to be concaved, or a more flexible resin material may be used.

An insulating resin layer is formed on insulating layer 26*d*. To form flow channel layer 26*b*, the insulating resin layer, formed of resoluble resin layer, is removed, while predetermined pattern to form flow channel 27 and liquid solution chamber 24 remains, that is, this remaining pattern becomes flow channel layer 26*b*.

Next, ejecting electrode 28 is formed by such a way that firstly an electro-conductive material, such as NiP, is flatly coated on the insulating resin layer, on which an insulating resist resin layer or a parylene layer is formed. Since the resist resin layer becomes nozzle plate 26*c*, the thickness of the resist resin layer is determined in view of the height of nozzle 21. Further, this insulating resist resin layer is exposed by an electronic beam method or a femto-second laser, whereby a nozzle shape is formed. Flow channel 22 is also formed by laser machining. Then the resoluble resin layers for making the patterns of flow channel 27 and liquid solution chamber 24 are removed, by which flow channel 27 and liquid solution chamber 24 are open to flow, and finally liquid ejecting head 26 is established.

In addition, it is the preferable production method that nozzle plate 26*c* and nozzle 21 are structured of a low electro-conductive material. In liquid ejecting apparatus 20, since height H of each nozzle 21 is equal to or less than 30 μm, the electric field concentration reduces in flow channel 22, which results in the reduction of electrostatic sucking force. If the low electro-conductive material is used for the material to structure nozzle 21, the electric field concentration can be increased in flow channel 22, while height H of nozzle 21 is maintained low.

Figure 9:
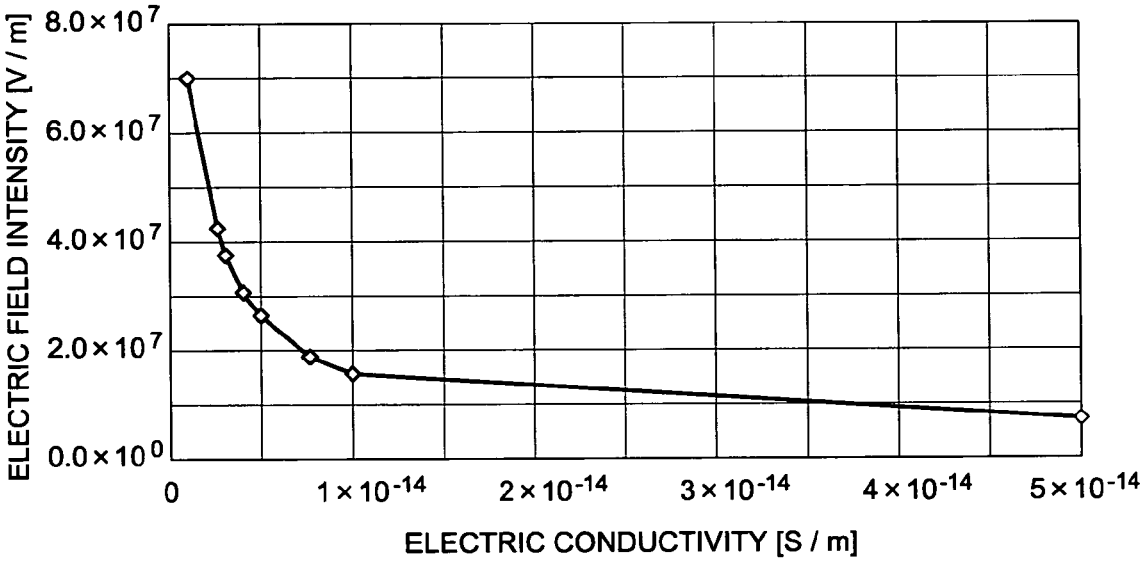
FIG. 9 shows the general relationship between electric conductivity of a material used to structure the nozzle and electric field intensity.

In order to obtain the desired electric field concentration effect in flow channel 22, each nozzle 21 is preferably structured of a material whose electric conductivity is equal to or less than $10^{-13}$ S/m, and more preferably, equal to or less than $10^{-14}$ S/m (see FIG. 9).

As such materials, cited may be quartz glass, various resins, such as polyimide resin, tetrafluoroethylene resin, polyethylene, phenol resin, epoxy resin, polypropylene resin, fluorocarbon resin, polyethyleneterephthalate resin (PET), polyethylene-2, 6-naphthalendicarboxylate resin (PEN), and polyester resin, and ceramics.

Based on the materials, each nozzle 21 structured of the above materials can be formed by various methods, such as dry etching, injection molding, hot embossing, imprinting, laser machining, photo-lithography of dry film, electro-casting, and electro-coating. Of these methods, combining two or more methods may be used.

Further, other than above materials, nozzle 21 and nozzle plate 26*c* may be structured of semi-conductors, such as Si, or conductors, such as Ni and stainless steel. If nozzle 21 and nozzle plate 26*c* are formed of a conductive material, at least the edge of top end 21*a* of nozzle 21, or more preferably, the periphery of top end 21*a*, is covered with an insulating material. If nozzle 21 is formed of the insulating material, or if the surface of top end 21*a* is coated with the insulating material, electric leakage from top end 21*a* of nozzle 21 to opposed electrode 23 can be effectively controlled, when the ejection voltage is applied to the liquid solution.

Figure 10:
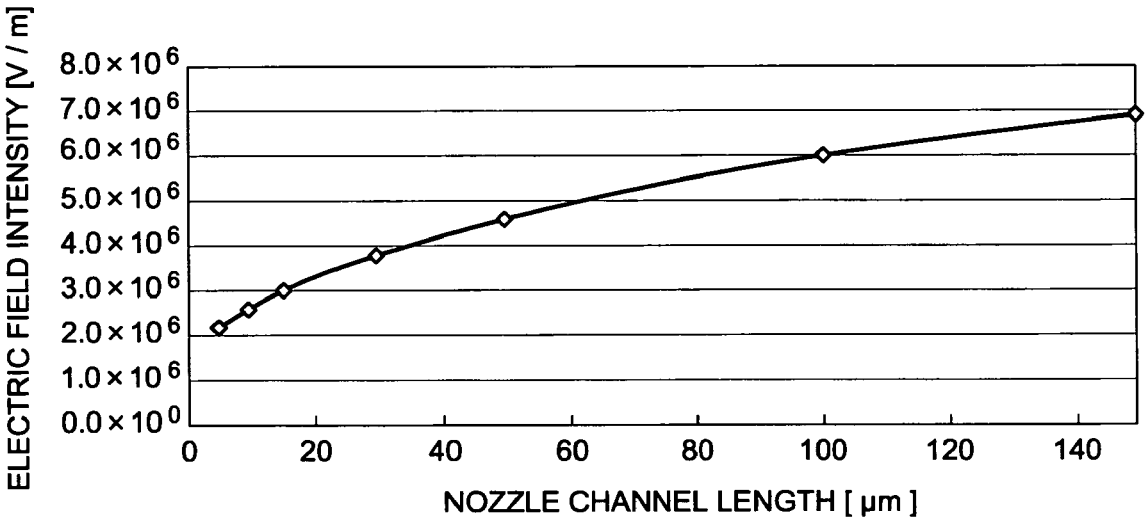
FIG. 10 shows the general relationship between the nozzle channel length and electric field intensity.

Further, concerning flow channel 22, which is formed in nozzle 21 and nozzle plate 26*c*, flow channel 22 is formed from top end 21 a of nozzle 21 to liquid solution chamber 24. Flow channel length L (see FIG. 2) is preferably equal to or greater than 75 μm, or more preferably, equal to or greater than 100 μm, based on the electric field intensity at top end 21*a* of nozzle 21 (see FIG. 10). The upper limit of flow channel length L of nozzle 21 should be determined relatively, based on the viscosity of the ejecting liquid solution, because the longer flow channel length L, the larger the pressure loss in flow channel 22, which results in ineffective ejection of the liquid solution.

(Opposed Electrode)

Flat-plate opposed electrode 23 has the opposed surface which is perpendicular to the projecting direction of nozzle 21, and supports base material K which is parallel with the above described opposed surface. The distance between top end 21*a* of nozzle 21 and the opposed surface of opposed electrode 23 is preferably equal to or less than 500 μm, or more preferably, equal to or less than 100 μm, and length H is set to 100 μm as an example. Further, opposed electrode 23 is connected to ground so that opposed electrode 23 constantly carries the ground voltage. Accordingly, the ejected droplets are induced toward opposed electrode 23 by the electro-static force of the electric field generated between top end 21*a* of nozzle 21 and the opposed surface of opposed electrode 23.

In addition, liquid ejecting apparatus 20 ejects droplets, while increasing the electric field intensity by the electric field concentration at top ends 21*a* of ultra-minute nozzles 21. Accordingly the droplets can be ejected without the induction conducted by opposed electrode 23, however, it is more preferable that the induction is conducted by the electrostatic force between nozzles 21 and opposed electrode 23. Further, it is also possible that the electric charge of the charged droplet is escaped through grounded opposed electrode 23. Still further, opposed electrode 23 need not be a flat plate, but may be a drum.

(Convex Meniscus Forming Section)

Convex meniscus forming section 40 includes piezo element 41 which is a piezoelectric element mounted on a position corresponding to liquid solution chamber 24 at the outer surface (a lower surface in FIG. 1) of flexible base layer 26*a* of liquid ejecting head 26, and drive voltage power supply 42 to apply a sharply-rising driving pulse voltage so as to change the form of piezo element 41.

Piezo element 41 is mounted on flexible base layer 26*a*, and when piezo element 41 receives the driving pulse voltage, piezo element 41 causes flexible base layer 26*a* to deform either inward or outward.

Drive voltage power supply 42 outputs an adequate driving pulse voltage (for example, 10 V) so that piezo element 41 reduces the volume of liquid solution chamber 24, and thereby a condition [see FIG. 4(A)], in which the liquid solution in flow channel 22 does not form a concave meniscus at top end 21*a* of nozzle 21, changes to the condition [see FIG. 4(B)] in which the liquid solution in flow channel 22 becomes a concave meniscus.

Figure 11:
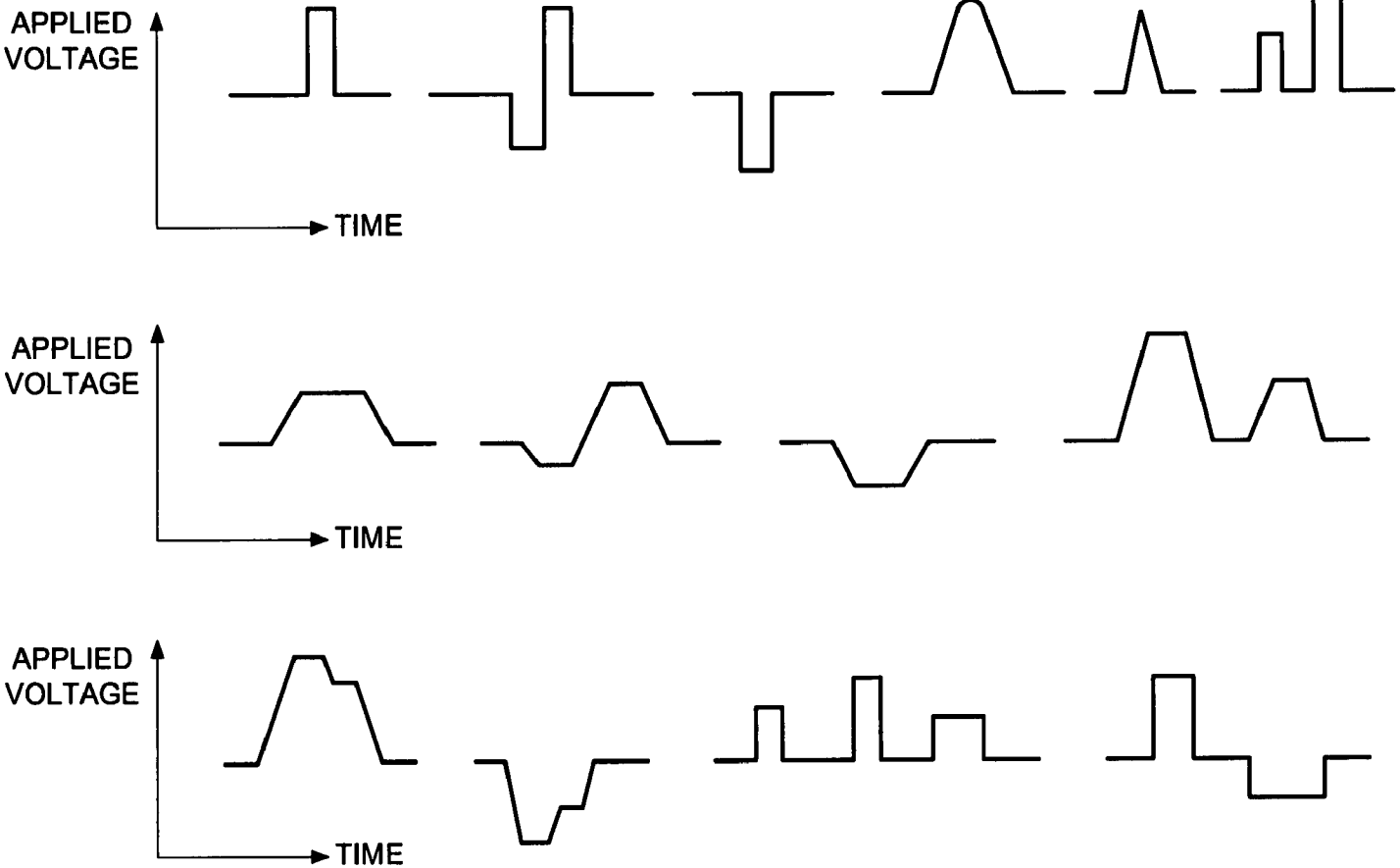
FIG. 11 shows examples of wave forms of the applied voltage to the piezo element.

In addition, the voltage applied to piezo element 41 to form a meniscus at the top end 21*a* of nozzle 21 is not limited to the wave form shown in FIG. 4(B), but various wave forms shown in FIG. 11 are also effective to use.

(Liquid Solution)

Concerning the examples of the liquid solution to be used in the above-described liquid ejecting apparatus 20, water, $COCL_2$, HBr, $HNO_3$, $H_2PO_4$, $H_2SO_4$, $SOCl_2$, $SO_2Cl_2$ and $FSO_3H$ are cited as an inorganic liquid.

As organic liquids, cited are a type of alcohol, such as methanol, n-propanol, isopropanol, n-butanol, 2-methyl-1-propanol, tert-butanol, 4-methyl-2-pentanol, benzyl alcohol, α-terpineol, ethyleneglycol, glycerine, diethyleneglycol and triethyleneglycol; a type of phenol, such as phenol itself, o-cresol, m-cresol and p-cresol; a type of ether, such as dioxane, furfural, ethyleneglycoldimethylether, methylcellosolve, ethylcellosolve, butylcellosolve, ethylcarbitol, butylcarbitol, butylcarbitolacetate and epichlorohydrin; a type of ketone, such as acetone, methylethylketone, 2-methyl-4-pentanone and acetophenone; a type of fatty acid, such as formic acid, acetic acid, dichloroacetic acid and trichloroacetic acid; a type of ester, such as methyl formate, ethyl formate, methyl acetate, ethyl acetate, acetic acid-n-butyl, isobutyl acetate, acetic acid-3-methoxybutyl, acetic acid-n-pentyl, ethyl propionate, ethyl lactate, methyl benzoate, diethyl malonate, dimethyl phthalate, diethyl phthalate, diethyl carbonate, ethylene carbonate, propylene carbonate, cellosolveacetate, butylcarbitolacetate, ethyl acetoacetate, methyl cyanoacetate and ethyl cyanoacetate; a type of nitrogen compound, such as nitromethane, nitrobenzene, acetonitrile, propionitrile, succinonitrile, valeronitrile, benzonitrile, ethylamine, diethylamine, ethylenediamine, aniline, N-methylaniline, N,N-dimethylaniline, o-toluidine, p-toluidine, piperidine, pyridine, α-picoline, 2,6-lutidine, quinoline, propylenediamine, formamide, N-methylformamide, N,N-dimethylformamide, N,N-diethylformamide, acetamide, N-methylacetoamide, N-methylpropionamide, N,N,N', N'-tetramethyl urea and N-methylpyrrolidone; a type of sulfur compound, such as dimethylsulfoxide and sulfolane; a type of hydrocarbon, such as benzene, p-cymene, naphthalene, cyclohexylbenzene and cyclohexane; and a type of halogenated hydrocarbon, such as 1,1-dichloroethane, 1,2-dichloroethane, 1,1,1-trichloroethane, 1,1,1,2-tetrachloroethane, 1,1,2,2-tetrachloroethane, pentachloroethane, 1,2-dichloroethylene (cis-), tetrachloroethylene, 2-chlorobutane, 1-chloro-2-methylpropane, 2-chloro-2-methylpropane, bromomethane, tribromomethane and 1-bromopropane.

Further, a liquid solution of more than two types of the above described liquid can also be used.

Still further, when an electrically-conductive paste including a highly electric conductive material (such as silver powder) is used for the ejection, as an objective material to be dissolved or dispersed in the above-described liquid, there is no specific limitation except for the particles of the material which are so large that they clog nozzles.

As a fluorescent material, such as PDP, CRT and FED, any material well known in the prior art can be used without limitation. For example, for red fluorescent material, (Y, Gd) $BO_3$:Eu and $YO_3$:Eu, for green fluorescent material, $Zn_2SiO_4$:Mn, $BaAl_{12}O_{19}$:Mn and (Ba, Sr, Mg) O.α-$Al_2O_3$:Mn, and for blue fluorescent material, $BaMgAl_{14}O_{23}$:Eu and $BaMgAl_{10}O_{17}$:Eu are cited.

In order to more strongly adhere the above-described objective material onto the recording medium, it is preferable to add various binders. Appropriate binders to be used are, for example: cellulose and its derivatives, such as ethylcellulose, methylcellulose, nitrocellulose, acetylcellulose and hydroxyethyl cellulose; alkyd resin; (meta) acrylic resin and its metallic salt, such as polymethacrylateacid, polymethylmethacrylate, 2-ethylhexylmethacrylate.methacrylic acid copolymer and laurylmethacrylate.2-hydroxyethyl methacrylate copolymer; poly (meta) acrylamide resins, such as poly N-isopropylacrylamide and poly N,N-dimethylacrylamide; styrene based resins, such as polystyrene, acrylilonitrile.styrene copolymer, styrene.maleic acid copolymer and styrene.isoprene copolymer; styrene.acrylic resin, such as styrene.n-butylmethacrylate copolymer; various saturated or unsaturated polyester resins; polyolefin based resin, such as polypropylene; halogenated polymer, such as polyvinylchloride and polyvinylidene chloride; vinyl based resins, such as polyvinyl acetate and vinyl chloride.vinyl acetate copolymer; polycarbonate resin; epoxy based resin; polyurethane based resin; polyacetal resins, such as polyvinylformal, polyvinyl butyral and polyvinylacetal; polyethylene based resins, such as ethylene.vinyl acetate colopymer and ethylene.ethylacrylate copolymer resin; amide resin, such as benzoganamine; urea resin; melamine resin; polyvinyl alcohol resin and its anioncationic denaturation; polyvinylpyrrolidone and its copolymer; alkylene oxide homopolymer, alkylene oxide copolymers and alkylene oxide cross-linked polymers, such as polyethyleneoxide and carboxylated polyethyleneoxide; polyalkyleneglycol, such as polyethyleneglycol and polypropyleneglycol; polyetherpolyol; SBR and NBR latex; dextrin; sodium alginate; natural or semi-synthetic resins, such as gelatine and its derivative, casein, Hibiscus manihot L., tragacanthgum, pullulan, gum Arabic, locustbean gum, Cyamoposis Gum, pectine, carrageen, hide glue, albumin, various starches, corn starch, alimentary yam paste, gluten paste, agar and soy protein; terpene resin; ketone resin; rosin and rosin ester; polyvinyl methyl ether, polyethyleneimine, sulf-polystyrene and sulf-polyvinyl.

These resins can be used as a homopolymer, as well as blended via melting.

To use liquid ejecting apparatus 20 as the patterning method, apparatus 20 can be typically used for the members assembled in the display, such as formation of a fluorescent substance of the plasma display, formation of a rib of the plasma display, formation of an electrode of the plasma display, formation of a fluorescent substance of CRT, formation of a fluorescent substance of FED (field emission display), formation of a rib of FED, color filters (RGB color layers and black matrix layer) of the liquid crystal display, and a spacer (which is a pattern or dot pattern corresponding to the black matrix) of the liquid crystal display. The above-mentioned rib generally means a barrier, which is used to separate the plasma area of each color in the case of the plasma display. Other usages are as follows: a micro lens; magnetic material for use as a semi-conductor; a ferroelectric substance; a patterning application such as an electric conductive paste (for wiring and an antenna); for graphic usage, regular printing, printing on specialized media (film, fabric and steel plate), curved surface printing, printing press plates of various types of printing; for processing usage, coating work using adhesives and sealants by the present invention; and for the bio-industry and medical services, coating of medicinal drugs (to mix plural minute amounts of components) and gene diagnosis samples.

(Operation Control Section)

Operation control section 50 has an operational device including CPU 51, ROM 52 and RAM 53, in which predetermined programs are inputted to realize the functional structures to be described below, and thereby operation control section 50 controls after-described operations.

Operation control section 50 performs the pulse voltage output control of voltage power supply 42 of convex meniscus forming section 40, and the pulse voltage output control of pulse voltage power supply 30 of ejection voltage applying section 25.

Firstly, to eject the liquid solution by a power supply control program stored in ROM 52, CPU 51 of operation control section 50 initially causes pulse voltage power supply 42 of convex meniscus forming section 40 to be under a pulse voltage outputting condition, after which causes pulse voltage power supply 30 of ejection voltage applying section 25 to be under a pulse voltage outputting condition. In this case, the pulse voltage as the drive voltage of convex meniscus forming section 40 is controlled to overlap on the pulse voltage of ejection voltage applying section 25 (see FIG. 5), whereby, the droplet is ejected at overlapped timing.

Further, immediately after the pulse voltage is applied, wherein the pulse voltage is an ejection voltage of ejection voltage applying section 25 and whose wave form is rectangular, operation control section 50 controls to output a reverse polarity voltage. The reverse polarity voltage is smaller than the voltage while the pulse voltage is not applied, and the wave form of the reverse polarity voltage is rectangular, but falls downward.

(Ejecting Operation of the Ultra-Fine Droplets By Liquid Ejecting Apparatus 20)

Figure 4:
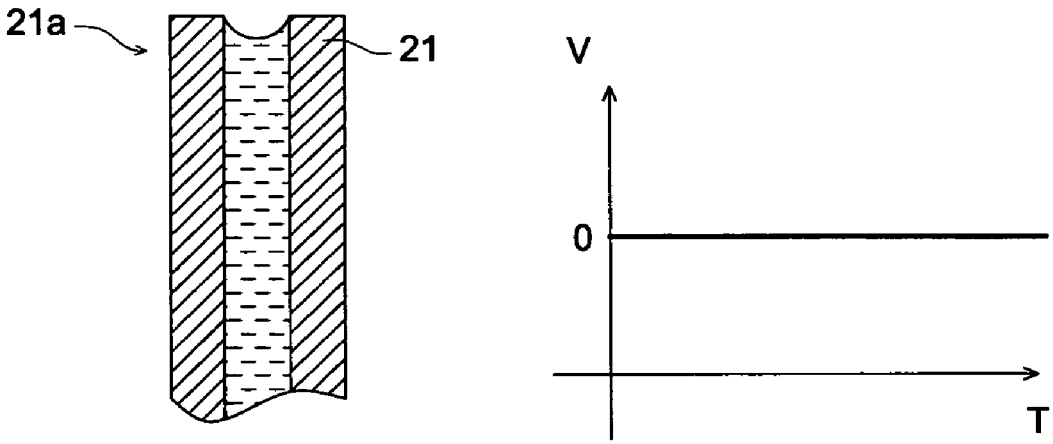
Figure 4:
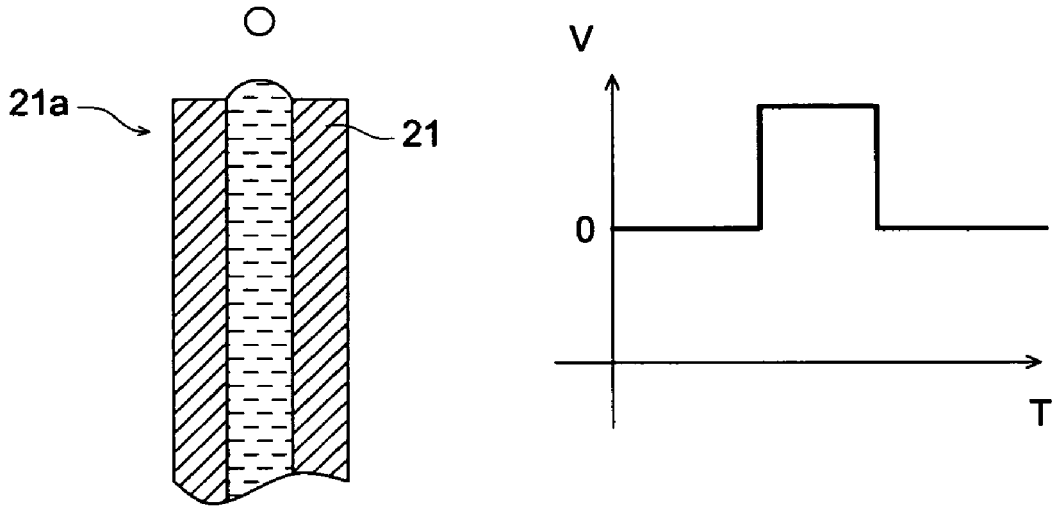
Figure 5:
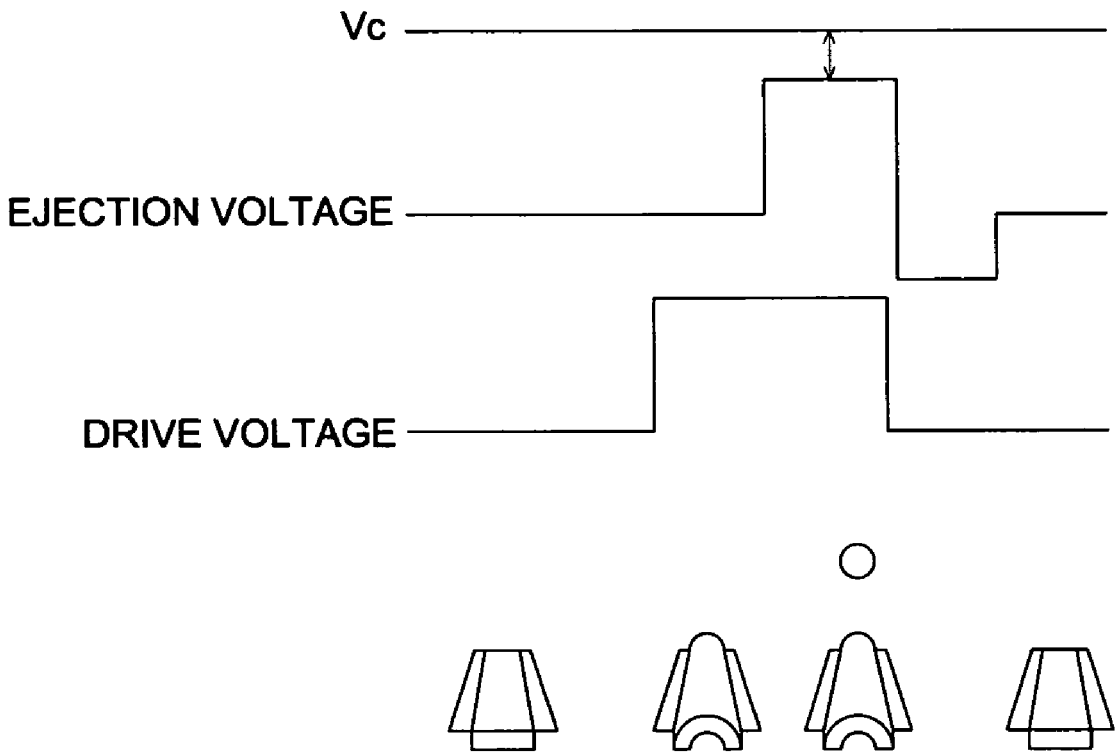
FIG. 5 is a timing chart of the ejection voltage and drive voltage of a piezo element.

The operation of liquid ejecting apparatus 20 will now be detailed while referring to FIGS. 1, 4 and 5.

FIG. 4 is a drawing to explain the operation of convex meniscus forming section 40, wherein FIG. 4(A) shows the condition in which no drive voltage is applied, and FIG. 4(B) shows the condition in which the drive voltage is applied. FIG. 5 shows a timing chart of the ejection voltage, and a timing chart of the drive voltage of a piezo element. In addition, potential of ejection voltage to be used when convex meniscus forming section 40 does not exist, is shown on the top of FIG. 5, while the change of the liquid condition of top end 21*a* of nozzle 21 due to the applied voltage, is shown on the bottom of FIG. 5.

Under the condition that the supplying pump of liquid solution supplying section 29 has supplied the liquid solution to each flow channel 22, liquid solution chamber 24 and nozzle 21, when operation control section 50 externally receives an instruction to eject the liquid solution from specific nozzle 21 for example, for convex meniscus forming section 40 of specific nozzle 21, operation control section 50 applies the drive voltage, which is the pulse voltage generated by pulse voltage power supply 42, to piezo element 41. Then, the convex-shaped meniscus is formed on top end 21*a* of specific nozzle 21, that is, the condition of top end 21*a* changes from FIG. 4(A) to FIG. 4(B). During this change, operation control section 50 controls ejection voltage applying section 25 to apply the ejection voltage as the pulse voltage, from pulse voltage power supply 30 to ejecting electrode 28.

As shown in FIG. 5, the drive voltage of convex meniscus forming section 40 and the ejection voltage of ejection voltage applying section 25 applied after the above drive voltage, are controlled to overlap the timings of their rise-up conditions. Due to this control, the liquid solution is electrically charged under the convex meniscus forming condition, and thereby, minute droplets are ejected from top end 21*a* of nozzle 21 by the electric field concentration effect, which is generated at the top end of the convex-shaped meniscus.

Based on above-described liquid ejecting apparatus 20, since the height of nozzle 21 is determined to be equal to or less than 30 μm, a wiping member hardly ever hooks onto nozzles 21 while cleaning them. Therefore, wiping can be conducted with relative ease for cleaning, and it is possible to prevent damage to nozzles 21 caused by hooking of the wiping member, or to prevent a part of the wiping member from attaching to nozzle 21, which can then properly retain satisfactory ejecting performance of the nozzle.

In addition, the present invention is not limited to the above-described embodiment, but any improvement or change of the design can be allowed within the spirit of the present invention.

Various examples will be shown below. Only the matters described below differ from the matters described above. The remaining matters are the same as the matters described above.

Figure 6:
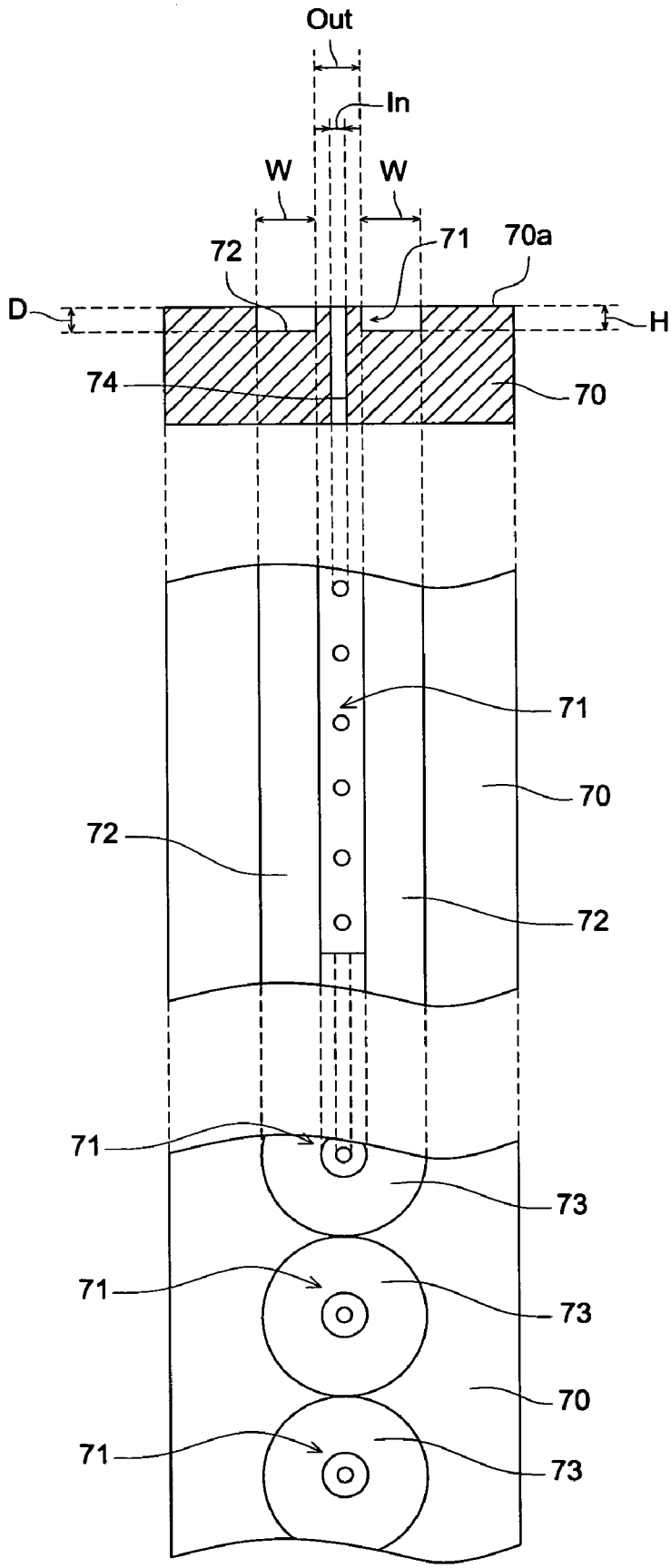

As one varied example, instead of nozzle plate 26*c* and nozzle 21, nozzle plate 70 and nozzle 71, each having different figure respectively in FIG. 6, can be used. FIGS. 6(A) and 6(B) show a variation of nozzle plate 26*c* and nozzle 21 in FIGS. 1 and 2. Upper FIG. 6(A) shows the sectional view of nozzle plate 70 and nozzle 71, while lower FIG. 6(A) shows the plan view of nozzle plate 70 and nozzle 71, and FIG. 6(B) is the plan view of the variation of FIG. 6(A).

In FIG. 6(A), plural nozzles 71 are aligned at even intervals on the central section of nozzle plate 70. When the inner diameter of nozzle 71 is represented by "In", while the outer diameter of nozzle 71 is represented by "Out" (which shows the width of nozzle 71 in the direction orthogonal to the aligning direction of nozzles 71), inner diameter "In" and outer diameter "Out" of each nozzle 71 are arranged along a predetermined line. Grooves 72 as grooves are formed respectively on the central right and left sections of nozzles 71 in FIG. 6(A). Each Groove 72 is formed to be in alignment with the line of nozzles 71.

When the width of groove 72 is represented by "W", width "W" of each groove 72 is determined within 3-1,000 μm, and more preferably, width "W" is formed to be 10-100 μm.

When the depth of groove 72 is represented by "D", depth "D" of groove 72 is determined within 1-30 μm. When the height of nozzle 71 is represented by "T", depth "D" of groove 72 is equal to height "T" of nozzle 71. That is, the surface [which shows the upper surface of nozzle plate 70 in the upper figure of FIG. 6(A), which is hereinafter referred to as "nozzle plane 70*a*"] of nozzle plate 70, and the edge [the upper surface in the upper figure of FIG. 6(A)] of top end 71*a* of nozzle 71, exist on the same surface.

In addition, to increase a pitch (which means an interval of each nozzle 71), it is also possible to form circular groove 73 to surround nozzle 71, instead of groove 72 as shown in FIG. 6(B). In this case, the width and depth of circular groove 73 are preferably the same as width W and depth D of groove 72.

Further, the features of flow channel 74 formed in nozzle 71, groove 72 and nozzle 71 can also be changed to the features shown in FIGS. 7(A)-7(E). That is, in FIG. 7(A), flow channel 74 can be formed to be tapered in such a way that the deeper the groove 72, the narrower width "W" of groove 72. Further flow channel 74 can be formed in such a way that the taper is formed only from the base to mid-way, while a channel is formed at the same inner diameter from mid-way to the top end shown in FIG. 7(B).

Figure 7:
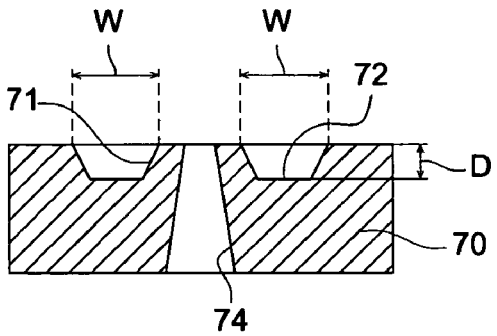
FIGS. 7(A)-(E) show the cross sectional views of the varied examples of the nozzle and the flow channel, which vary from those in FIG. 6.
Figure 7:
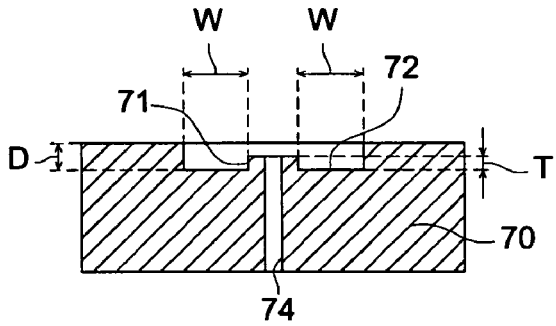
Figure 7:
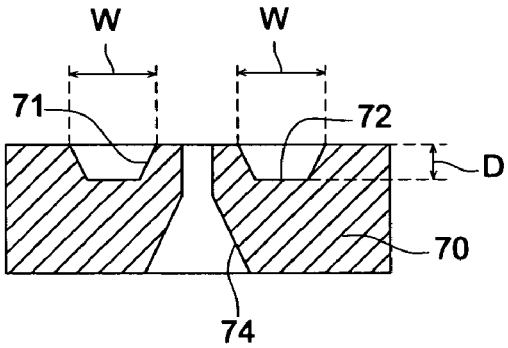
Figure 7:
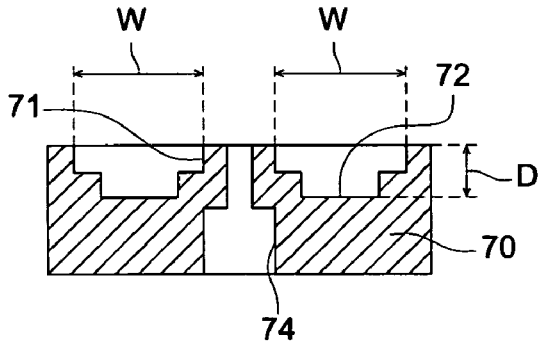
Figure 7:
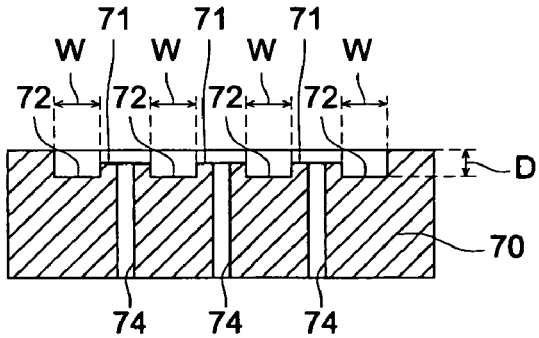

As shown in FIG. 7(C), it is also possible to structure the groove in such a way that the inner diameter of flow channel 74 is kept constant, and depth "D" is formed greater than height "T" of nozzle 71. In this case, depth "D" is preferably formed to be 1-20 μm greater than height "T" of nozzle 71. Further, as shown in FIG. 7(D), it is also possible to structure the groove in such a way that a step is formed in groove 72 to narrow the width of the bottom more than the width of the open section, a step can also be formed in flow channel 74 so that the inner diameter from the base to mid-way upward is greater than the inner diameter from mid-way to the top.

As further variations of FIGS. 6(A) and 6(B), and FIGS. 7(A)-7(D), FIG. 7(E) shows that nozzles 71 are aligned in plural lines, and grooves 72 are formed at both sides of the lines of nozzles 71. The feature in FIG. 7(E) specifically shows the variation of FIG. 7(C), and the features of nozzle 71, groove 72, and flow channel 74 can be applied to each feature in FIGS. 6(A) and 6(B), and FIGS. 7(A)-7(D).

As described above, under the condition that groove 72 and groove 73 are formed around nozzles 71, since a part of pressure is applied onto the inner surface of groove 72 and groove 73 by the wiping member during cleaning of liquid ejecting head 26, the wiping member is less likely to hook onto nozzles 21 because the pressure applied onto nozzle 71 by the wiping member is reduced. Therefore, trouble-free wiping can be conducted with ease for cleaning, and it is possible to prevent damage to nozzles 71 caused by hooking of the wiping member, or to prevent parts of the wiping member from attaching to nozzle 71, which can then properly maintain the required ejecting performance of the nozzle.

Embodiment 1

Various nozzle plates were tested in present Embodiment 1, in which the height of nozzles, the depth and width of the grooves around the nozzles were changed to study the functional characteristics of each nozzle plate.

(1) Production of the Nozzle Plates

Nozzle plates 26*c* shown in FIGS. 1 and 2 were produced by dry etching of a quartz glass wafer at a thickness of 300 μm, that is, five types of nozzle plates were produced in which the number of the nozzles was thirty, with a nozzle pitch of 100 μm, which corresponds to nozzle plates 26*c* in FIGS. 1 and 2, which are referred to as "nozzle plates 1-5", and which are further detailed in Table 1.

Other than nozzle plates 1-5, eight types of nozzle plates were tested in which thirty nozzles existed with the nozzle pitch of 100 μm, which corresponds to nozzle plates 70 in FIG. 6(A), and which are referred to as "nozzle plates 21-28". Specifically, after the quartz glass wafers, coated with photoresist, were exposed and processed, a protective coating was applied onto those sections which did not correspond to the inner diameter section of the nozzles, after which a penetrating hole was formed by RIE dry-etching, the penetrating hole corresponds to flow channel 74 in FIG. 6(A). Next, a photoresist coating and the same process as above were conducted to produce a protective pattern of the groove. The width of the groove was controlled by selected patterns of an exposure mask. The height of the nozzle and the depth of the groove were controlled by changing dry-etching time. Table 1 shows further details of the nozzle plate.

(2) Evaluation of Scratch Resistance

Firstly, for nozzle plates 1-5, and 21-28, surfaces on which the nozzles are formed (which are surfaces corresponding to the nozzle planes) are wetted with water. Next, the surfaces are wiped 30,000 times with a rubber blade, and the damage of the nozzles and the remaining rubber residue on the nozzle surface are closely observed. Table 1 shows the results.

In Table 1, "damage" is judged on the base of the standards shown below.

"A" represents no damage on the nozzle.

"B" represents no damage on the nozzle by unaided visible examination, but damage was found by electronic microscope inspection.

"C" represents damage was clearly visible on the nozzle.

In Table 1, "rubber residue" is judged on the basis of the standards shown below.

"A" represents no remaining rubber residue.

"B" represents that remaining rubber residue was not found by visually, but were found by electronic microscope inspection.

"C" represents that rubber residues were clearly visible to the unaided eye.

In addition, the same tests as above were carried out, with nozzle plates formed of a polyimide resin base, instead of the quartz glass wafer, such as nozzle plates 1-5 and 21-28, and any damage of the nozzle and the remaining rubber residues were checked for, and the same results as in Table 1 were obtained.

(3) Evaluation of the Ejecting Characteristics

Nozzle plates 1-5 and 21-28 are used for ink ejecting heads corresponding to liquid ejecting head 26 in FIG. 1. A microscope camera was installed at the sides of nozzle plates 1-5 and 21-28. The microscope camera photographed the ink ejected from the nozzle of nozzle plates 1-5 and 21-28. Table 1 shows the photographed results.

In Table 1, "ejecting characteristics" is judged on the basis of the standards shown below.

"A" represents that the ink is ejected based on the controlled signals.

"B" represents that the ink is unstably ejected (which results in defecting printed images).

"C" represents no ejection of the ink.

Embodiment 2

In Embodiment 2, water repellent finished nozzle plates, and non-water repellent finished nozzle plates are compared.

(1) Production of the Nozzle Plates

Four types of nozzle plates formed of a polyimide resin base were produced for the test, instead of nozzle plate 23 (see Embodiment 1) formed of the quartz glass wafer, and one of the four types of the nozzles was referred to as "nozzle plate 31". The remaining three nozzles were finished to be water repellent. One of the remaining three nozzles was coated (after the base was coated with an FEP fine grain dispersion liquid, the base was heated in 880 ° C. for a fusion bond), and the base was coated with 0.05 μm of FEP which was referred to as "nozzle plate 32". For the other two nozzles, a filtered cathodic vacuum arc process was conducted (being FCAV system of Nano Film Technologies International Co.), and the base of one was coated with a 0.05 μm ta-C coating, which was referred to as "nozzle plate 33", while the other was coated with a 0.05 μm MiCC coating, which was referred to as "nozzle plate 34".

(2) Evaluation of Scratch Resistance And Measurement of the Contact Angle

Damage and remaining rubber residues on nozzle plates 31-34 were checked for at the same criteria and standards as those of item (1) of Embodiment 1. Further, with purified water, the contact angles before and after wiping movement by the rubber blade on the surface of which the nozzle was formed (the surface corresponding to the nozzle plane), were measured for nozzle plates 31-34. The evaluation and the measured results are shown in Table 2.

(3) Evaluation of the Ejecting Characteristics

The ink ejecting characteristics of nozzle plates 31-34 are evaluated by the same contents and standards as Item (1) of Embodiment 1. Table 1 shows the results.

TABLE 1

| | Nozzle | | | Groove around nozzle | | Scratch resistance | | |
|---|---|---|---|---|---|---|---|---|
| Nozzle plate | Height (μm) | Inner diameter (μm) | Outer diameter (μm) | Depth (μm) | Width (μm) | Damage | Remaining particle | *1 |
| 1 | 30 | 20 | 24 | — | — | A | B | A |
| 2 | 60 | 20 | 24 | — | — | C | C | C |
| 3 | 30 | 10 | 11 | — | — | A | B | A |
| 4 | 30 | 3 | 4 | — | — | A | B | A |
| 5 | 30 | 0.8 | 1 | — | — | A | B | A |
| 21 | 3 | 20 | 24 | 3 | 50 | A | A | A |
| 22 | 10 | 20 | 24 | 10 | 50 | A | A | A |
| 23 | 30 | 20 | 24 | 30 | 50 | A | A | A |
| 24 | 60 | 20 | 24 | 60 | 50 | B | B | B |
| 25 | 30 | 20 | 24 | 30 | 3 | A | A | A |
| 26 | 30 | 20 | 24 | 30 | 10 | A | A | A |
| 27 | 30 | 20 | 24 | 30 | 100 | A | A | A |
| 28 | 30 | 20 | 24 | 30 | 1 | A | B | A |

*1: Ejection characteristics

TABLE 2

| Nozzle plate | Water repellent finished coat: Type of coat | Water repellent finished coat: Thickness of coat (μm) | Damage resistance: Damage | Damage resistance: Rubber residue | Contact angle (degree): Before wiping | Contact angle (degree): After wiping | *1 |
|---|---|---|---|---|---|---|---|
| 31 | — | — | A | A | 65 | 65 | A |
| 32 | FEP | 0.05 | A | A | 120 | 80 | A |
| 33 | ta-C | 0.05 | A | A | 85 | 85 | A |
| 34 | MiCC | 0.05 | A | A | 95 | 95 | A |

*1: Ejection characteristics

INDUSTRIAL AVAILABILITY

In the present structures, since the height of the nozzle is determined to be equal to or less than 30 μm, and the grooves are formed around the nozzles, a wiping member hardly ever hooks onto the nozzles while cleaning them. Therefore, wiping for cleaning can be conducted with ease, and it is possible to prevent damage to the nozzles caused by hooking of the wiping blade, or to prevent particles of the wiping member from attaching themselves to the nozzle, which can then properly retain targeted performance of ejecting liquid from the nozzle.

what is claimed is:

1. A liquid ejecting apparatus, which ejects droplets of electrically charged liquid solution onto a base member, comprising:

a liquid ejecting head to eject the droplets from a top portion of a nozzle;

a liquid solution supplying section to supply the liquid solution to the nozzle; and an ejection voltage applying section to apply an ejection voltage to the liquid solution in the nozzle; and an opposed electrode which is provided opposing to the nozzle through the base member;

wherein the liquid ejecting head comprises a nozzle plate having a nozzle plane which is opposed to the base member, and the nozzle arranged on the nozzle plate, and a liquid solution chamber provided on the opposite side of the nozzle plate to the nozzle plane side, an inside diameter of the nozzle being equal to or less than 100 μm; and wherein the nozzle is protruded from a nozzle plane in an ejecting direction of the droplets and a protruded height of the nozzle is equal to or less than 30 μm, a length of a flow channel formed in the protruded part of the nozzle and through the nozzle plate reaching to the liquid solution chamber is equal to or greater than 75 μm, and electric conductivity of a material structuring the nozzle is equal to or less than $10^{-13}$S/m.

2. The liquid ejecting apparatus described in claim 1, wherein the protruded height of the nozzle is equal to or higher than 3 μm but less than 10 μm.

3. The liquid ejecting apparatus described in claim 1, wherein a length of a flow channel formed in the nozzle is equal to or greater than 100 μm.

4. The liquid ejecting apparatus described in claim 1, wherein the electric conductivity of a material structuring the nozzle is equal to or less than $10^{-14}$ S/m.

5. The liquid ejecting apparatus described in claim 1, wherein a water repellent finish is applied on a surface of the nozzle.

6. The liquid ejecting apparatus described in claim 1, wherein a water repellent finish is applied on an inner surface of the flow channel formed in the nozzle.

7. The liquid ejecting apparatus described in claim 1, wherein the opposed electrode is plate shaped or drum shaped.

8. A liquid ejecting apparatus, which ejects droplets of electrically charged liquid solution onto a base member, comprising:

a liquid ejecting head to eject the droplets from a top portion of a nozzle;

a liquid solution supplying section to supply the liquid solution to the nozzle; and an ejection voltage applying section to apply an ejection voltage to the liquid solution in the nozzle; and an opposed electrode which is provided opposing to the nozzle through the base member;

wherein the liquid ejecting head comprises a nozzle plate having a nozzle plane which is opposed to the base member, and the nozzle arranged on the nozzle plate, an inside diameter of the nozzle being equal to or less than 100 μm; and wherein the nozzle is protruded from a nozzle plane in an ejecting direction of the droplets and a protruded height of the nozzle is equal to or less than 30 μm, a length of a flow channel formed in the nozzle is equal to or greater than 75 μm, and an inner diameter of the nozzle is equal to or less than 30 μm, and electric conductivity of a material structuring the nozzle is equal to or less than $10^{-13}$ S/m.

9. The liquid ejecting apparatus described in claim 8, wherein an inner diameter of the nozzle is equal to or less than 10 μm.

10. The liquid ejecting apparatus described in claim 8, wherein an inner diameter of the nozzle is equal to or less than 4 μm.

11. The liquid ejecting apparatus described in claim 8, wherein an inner diameter of the nozzle is equal to or greater than 0.1 μm, but less than 1 μm.

* * * * *

UNITED STATES PATENT AND TRADEMARK OFFICE

CERTIFICATE OF CORRECTION

PATENT NO. : 7,665,829 B2
APPLICATION NO. : 11/632408
DATED : February 23, 2010
INVENTOR(S) : Ueno et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 469 days.

Signed and Sealed this

Seventh Day of December, 2010

David J. Kappos

David J. Kappos
*Director of the United States Patent and Trademark Office*